US005182448A

United States Patent [19]

Ohtsuka et al.

[11] Patent Number: 5,182,448

[45] Date of Patent: Jan. 26, 1993

[54] PHOTOCOUPLER WITH IMPROVED ANTI-NOISE CHARACTERISTICS

[75] Inventors: Yoshihiro Ohtsuka, Nara; Yoshifumi Masuda, Kashihara, both of Japan

[73] Assignee: Sharp Kabushiki Kaisha, Japan

[21] Appl. No.: 764,923

[22] Filed: Sep. 24, 1991

[30] Foreign Application Priority Data

Oct. 5, 1990 [JP] Japan ..... 2-268668
Jun. 12, 1991 [JP] Japan ..... 3-140077

[51] Int. Cl.[5] ..... G08C 21/00
[52] U.S. Cl. ..... 250/214 B; 250/214 C
[58] Field of Search ..... 250/214 R, 214 B, 214 C, 250/221, 222.1, 551; 307/311; 359/127, 128

[56] References Cited

U.S. PATENT DOCUMENTS

| | | | |
|---|---|---|---|
| 3,913,001 | 10/1975 | Kayama | 250/551 |
| 4,140,914 | 2/1979 | Jones | 250/551 |
| 4,178,504 | 12/1979 | Farmer | 250/551 |
| 4,713,534 | 12/1987 | Masters et al. | 250/214 B |
| 4,714,827 | 12/1987 | Akita | 307/311 |
| 4,739,174 | 4/1988 | Nagano | 307/311 |
| 4,799,044 | 1/1989 | Masters et al. | 250/221 |
| 5,043,587 | 8/1991 | Miki et al. | 307/311 |

FOREIGN PATENT DOCUMENTS 62-44535 7/1987 Japan .

*Primary Examiner*—David C. Nelms
*Assistant Examiner*—Stephone B. Allen
*Attorney, Agent, or Firm*—Nixon & Vanderhye

[57] ABSTRACT

A light receiving section of a photocoupler according to the present invention has, for example, a light receiving element, a converting circuit, an oscillator, an up-down (U/D) counter, a decoder and a clock signal supply control circuit, and those devices are monolithically integrated therein. When the light receiving element receives light from a light generating section, an output of the converting circuit becomes High. At this time, an output of the decoder is delayed until the U/D counter has counted up to the preset number a clock signal supplied by the clock signal supply control circuit. On the other hand, upon having Low of the output of the converting circuit, the output of the decoder is delayed until the U/D counter has counted down to "0" the clock signal supplied by the clock signal supply control circuit. Therefore, even in the case where noise interferes the output of the converting circuit, since the output of the decoder is delayed until the count value of the U/D counter has reached the preset number or "0" in spite of switching of the operation of the U/D counter, it is not adversely affected by the noise. This results in improved anti-noise characteristics of the photocoupler.

16 Claims, 12 Drawing Sheets

PHOTOCOUPLER WITH IMPROVED ANTI-NOISE CHARACTERISTICS

FIELD OF THE INVENTION

The present invention relates to photocouplers, and more particularly to those provided in program controllers or other devices wherein output delay is necessary since noise such as chattering is contained in their input signal.

BACKGROUND OF THE INVENTION

A presently known photocoupler for use in program controllers or other devices is provided with an output delay circuit for delaying the output therefrom until the input thereto is stabilized so as to eliminate an adverse effect of chattering (a phenomenon wherein make-and-break occurs repeatedly) that takes place at contacts of relays or other devices. As shown in FIG. 9, a light receiving section for obtaining the output delay includes a light receiving element (photodiode) 1, an amplifier 2, comparators 3 and 4, and a capacitor 5. Here, in FIG. 9, the reference numeral 6 represents a constant-current circuit; 7 is a transistor; and 8 represents a negative feedback resistor. All the other parts in the light receiving section except for the capacitor 5 are monolithically integrated.

In general, a delay time $td_2$ for the output delay is given by:

$$td_2 = C \times Vref_2/i \ldots \quad (1),$$

where C represents a capacity of the capacitor 5; $Vref_2$ is a reference voltage of the comparator 4; and i is a current released from the constant-current circuit 6. Here, it is preferable to have an appropriately longer delay time $td_2$ so as to eliminate the adverse effect of chattering. In order to prolong the delay time $td_2$, it is advantageous to make i smaller in its value according to the equation (1). However, taking account of accuracy and reduction of dispersion in the integrated circuit, the current obtainable therein is limited to several $\mu$A.

For example, in order to obtain the delay time $td_2$ of 1 ms, suppose that a reference voltage of the comparator 4, $Vref_2 = 2$ V and $i = 1$ $\mu$A, the capacity C of the capacitor 5 is needed to be 500 pF. It is impossible to provide such a large capacity for the integrated circuit since it will occupy too large an area to be integrated. Therefore, only the capacitor 5 is added to the integrated circuit from the outside. This results in such a drawback that it becomes difficult to provide compact and light-weight photocouplers for use in program controllers or other devices.

Additionally, FIGS. 12 and 13 show a concrete example of a product of single-packaged photocoupler. The photocoupler 40 (Product Code PC902: manufactured by Sharp Corp.) is an AC input type photocoupler suitable for program controllers, whose light-generating section and light-receiving section are housed in a single package. Two parallel light emitting diodes having a reverse polarity to each other are connected between terminals $n_1$ and $n_2$ as the light-generating section, and an AC input is supplied thereto. A terminal $n_8$ is pulled up to a constant voltage, while a terminal $n_5$ is connected to ground. An output of the photocoupler 40 is obtained between the terminal $n_5$ and a terminal $n_7$. Further, an external capacitor $C_{EX}$ is connected between the terminal $n_5$ and a terminal $n_7$ for delaying the output. The reference numeral 40*a* represents a voltage regulator.

Here, contemplating the above drawback, the present invention provides a circuit configuration for a compact and light-weight photocoupler wherein a greater delay time can be obtained without adding a capacitor from the outside. In the arrangement as illustrated in FIG. 10, when a light receiving element 10 receives light, the output voltage ef an amplifier 11 rises and if it exceeds a reference voltage generated by a reference voltage circuit 14, a comparator 12 releases a signal I having High.

On the other hand, in an output delay circuit 13 is found an exclusive-OR between outputs of the comparator 12 and a D-type flipflop (D-FF) circuit 21 by an exclusive-OR circuit 31 of an exclusive logic circuit 30. Here, upon receipt of the signal I, the D-FF circuit 21 releases a signal VI having a predetermined delay time applied thereto by the use of a signal V as a clock signal generated by a frequency divider 20. The signal VI is sent to the next stage by way of an output buffer circuit 22.

Further, a NOT circuit 32 generates a signal II by inverting the output of the exclusive-OR circuit 31. This signal II forms a set signal for a low-active RS-type flipflop (RS-FF) circuit 17. Moreover, an AND gate 19 finds an AND between a signal III released by the RS-FF circuit 17 and an output of an oscillator 18. The frequency divider 20 divides down the signal IV indicating the AND to form the signal V. A reset circuit 33 produces a reset signal according to the signal V, and supplies it to the RS-FF circuit 17.

FIGS. 11(a) through 11(h) show a timing chart for individual signals I through VI in the output delay circuit 13. As shown in FIG. 11(a), when the signal I rises from Low to High, the output of the exclusive-OR circuit 31 also rises from Low to High, since the output of the D-FF circuit 21 is Low. As shown in FIG. 11(b), the NOT circuit 32 thus generates the signal II that falls from High to Low.

As described above, since the RS-FF circuit 17 is low-active, the signal III rises from Low to High as shown in FIG. 11(c). Consequently, the AND gate 19 opens, and the output of the oscillator 18 forms the signal IV to be supplied to the frequency divider 20, as shown in FIG. 11(d). The frequency divider 20 generates the signal V whose frequency is divided down, for example, as is shown in FIG. 11(e).

Using the signal V as a clock signal, the D-FF circuit 21 releases the signal VI that rises from Low to High when the signal V falls from High to Low. Thus, in comparison with the signal I, the signal VI has a delay time of one-half the cycle of the signal V generated by the frequency divider 20.

Therefore, without adding a capacitor from the outside, the output delay circuit 13 makes it possible to obtain such a great delay equivalent to that of the prior art arrangement. Consequently, the light receiving element 10, amplifier 11, comparator 12 and output delay circuit 13 can be monolithically integrated to form a light receiving section, thereby achieving a compact and light-weight circuit for a photocoupler.

However, in the above output delay circuit 13, as shown in FIG. 11(g), when the signal V falls from High to Low, if the signal I is forced to Low due to noise, the signal VI is kept Low as shown in FIG. 11(h), thereby causing malfunction. Thus, there is a drawback in that the signal VI tends to be unstable due to noise.

SUMMARY OF THE INVENTION

The present invention which provides a photocoupler having a light generating section for converting an input signal into light and a light receiving section for converting the light from the light generating section into a signal and releasing the signal after having the signal subjected to a delay until at least the input signal becomes stable, has the following objects:

(1) providing a circuit configuration for permitting the light receiving section to be monolithically integrated.

(2) miniaturizing the size of a chip whereon the light receiving section is monolithically integrated.

(3) providing desirable anti-noise characteristics of an output delay circuit installed in the light receiving section.

(4) providing stable operation of the output delay circuit.

In order to achieve the above objects, the photocoupler of the present invention is characterized in having at least the following means:

(a) light receiving means for receiving light from the light generating section (for example, photodiode).

(b) converting means for switching outputs from Low to High upon receipt of light by the light receiving means (for example, an amplifier for amplifying an output of the photodiode and a comparator for comparing an output of the amplifier with a reference voltage).

(c) oscillating means for generating a clock signal (for example, an oscillator).

(d) updown counter (hereinafter, referred to as U/D counter) for counting the clock signal within 0 and the preset number, which is capable of switching its operation between counting-up mode and counting-down mode according to an output of the converting means.

(e) decoder means (for example, a NAND circuit and an OR circuit each of which provides an input to each output of a plurality of flipflops forming the U/D counter) which switches an output thereof from Low to High when a counted value of the updown counter reaches a preset number after the updown counter started a counting-up operation in response to the first level change from Low to High of the output of the converting means; keeps the output thereof High until the preset number is counted down to "0" after the updown counter started a counting-down operation in response to the second level change from High to Low of the output of the converting means; switches the output from High to Low when the counted value equals to "0", and forms an output of the photocoupler as its own output.

(f) clock signal supply control means (for example, a logic circuit including an exclusive-OR circuit for obtaining an exclusive-OR of each output of the comparator and the U/D counter) which supplies a clock signal to the U/D counter since the first level change until a full-count state of the U/D counter; and supplies the clock signal again to the U/D counter since the second level change until the full-count value of the U/D counter has been counted down to "0".

Here, the light receiving means, converting means, oscillating means, U/D counter, decoder means and clock signal supply control means are monolithically integrated.

With the above arrangement, when the output of the converting means becomes High, the output of the decoder means is maintained Low and delayed until the U/D counter has counted up to the preset number the clock signal supplied by the clock signal supply control means.

On the other hand, when the output of the converting means becomes Low, the output of the decoder means is maintained High and delayed until the U/D counter has again counted down to "0" the clock signal supplied by the clock signal supply control means.

Here, if noise having a Low level interferes when the output of the converting means is High, the operation of the U/D counter is switched to the counting-down mode. However, since the output of the decoder means is maintained Low until the U/D counter has counted up to reach the preset number, it is not adversely affected by the noise. Similarly, if noise having a High level interferes when the output of the converting means is Low, the operation of the U/D counter is switched to the counting-up mode. However, since the output of the decoder means is maintained High until the full-count value of the U/D counter has been counted down to "0", it is not adversely affected by the noise.

In this manner, the photocoupler according to the present invention has improved anti-noise characteristics.

In addition, another arrangement may be adopted wherein an integrating circuit for integrating the output of the converting means is installed and operation of the U/D counter is switched according to an output of the integrating circuit. Then, even noise synchronized with the clock signal can be eliminated, thereby further improving anti-noise characteristics of the photocoupler.

Moreover, still another arrangement may be adopted wherein is provided dividing means for dividing the clock signal to generate a first sub-clock signal and a second sub-clock signal each having a different phase from the other, with the first sub-clock signal having at least either a falling pulse edge or a rising pulse edge synchronous with a pulse top of the second sub-clock signal. Then, in the arrangement, if the U/D counter is designed to receive the output of the converting means synchronized with a pulse edge of the first sub-clock signal while counting the second sub-clock signal, the operation of the U/D counter can be further stabilized.

For a fuller understanding of the nature and advantages of the invention, reference should be made to the ensuing detailed description taken in conjunction with the accompanying drawings.

DESCRIPTION OF THE EMBODIMENTS

A light-generating section and a light-receiving section of a photocoupler according to the present invention are housed in a single package. The light-generating section once converts an input signal into light, and then the light-receiving section receives the resulting converted light. Further, the light-receiving section converts the received light into an electric signal, and after making the electric signal undergo a delay until the input signal restores its stable state, releases the electric signal.

Additionally, the object of the present invention is to make the light-receiving section compact and light-weight, and therefore no description will be given to the light-generating section.

FIRST EMBODIMENT

Figure 1:
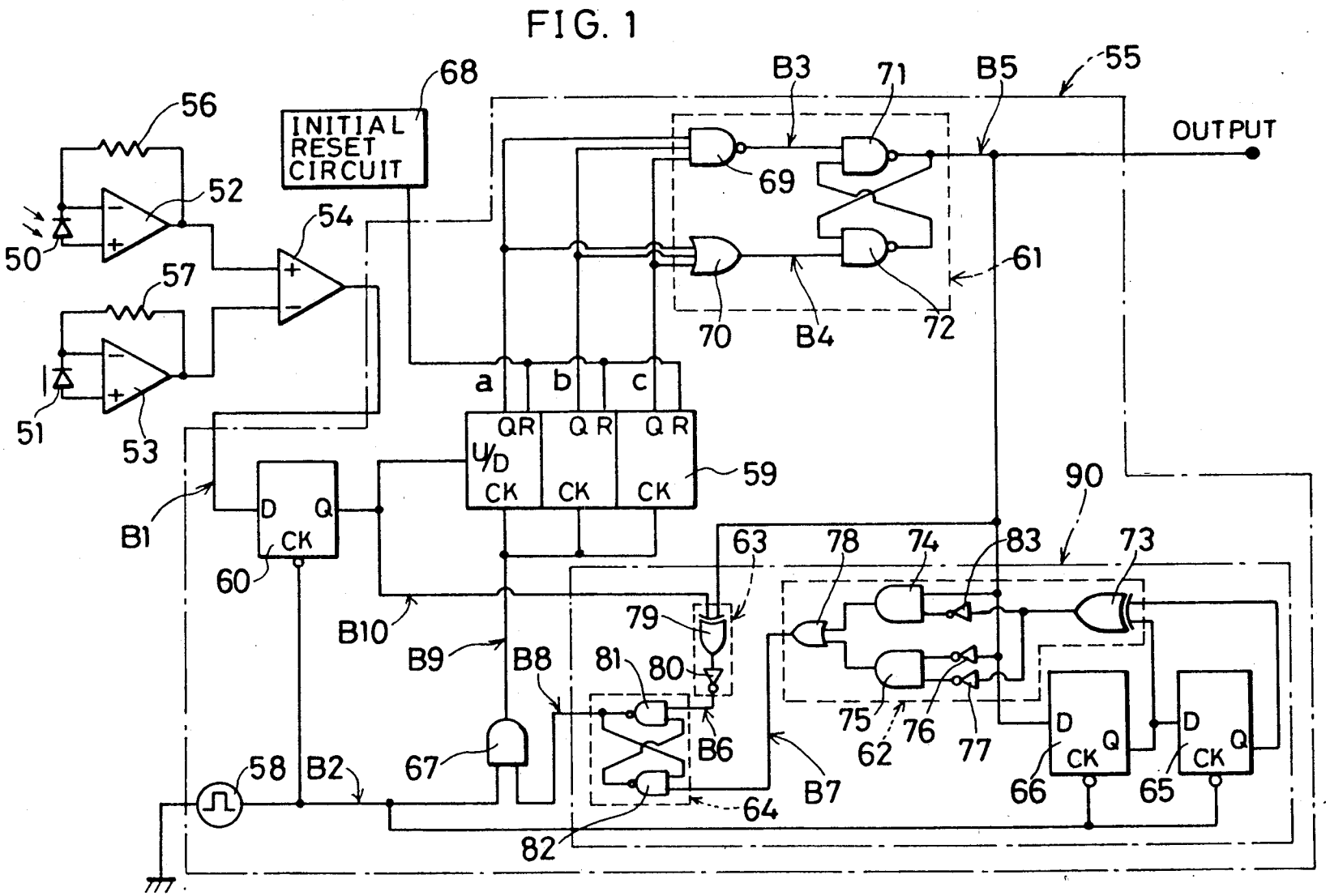
FIG. 1 is a circuit diagram showing one structural example of a light receiving section of a photocoupler according to the present invention.
Figure 2:
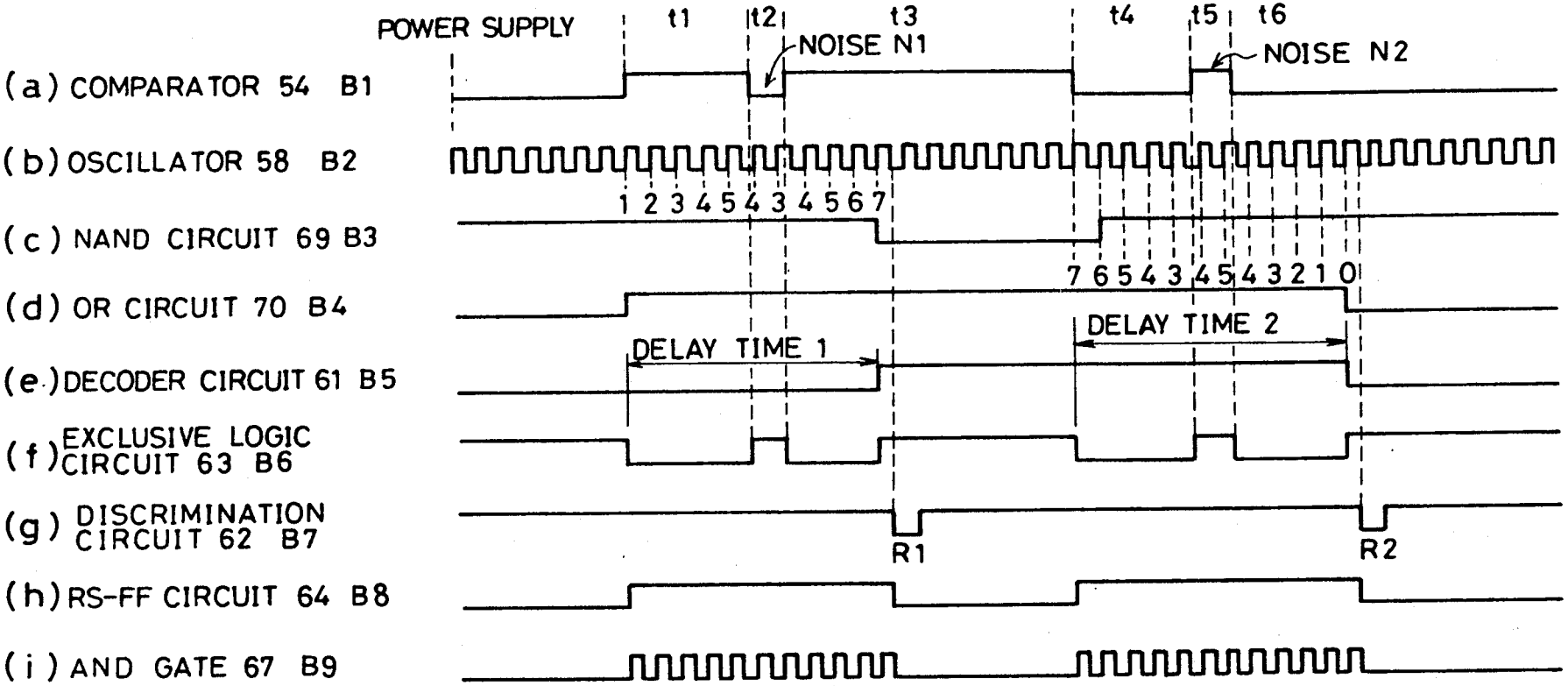
FIG. 2 is a timing chart showing each output in the light receiving section of FIG. 1.
Figure 3:
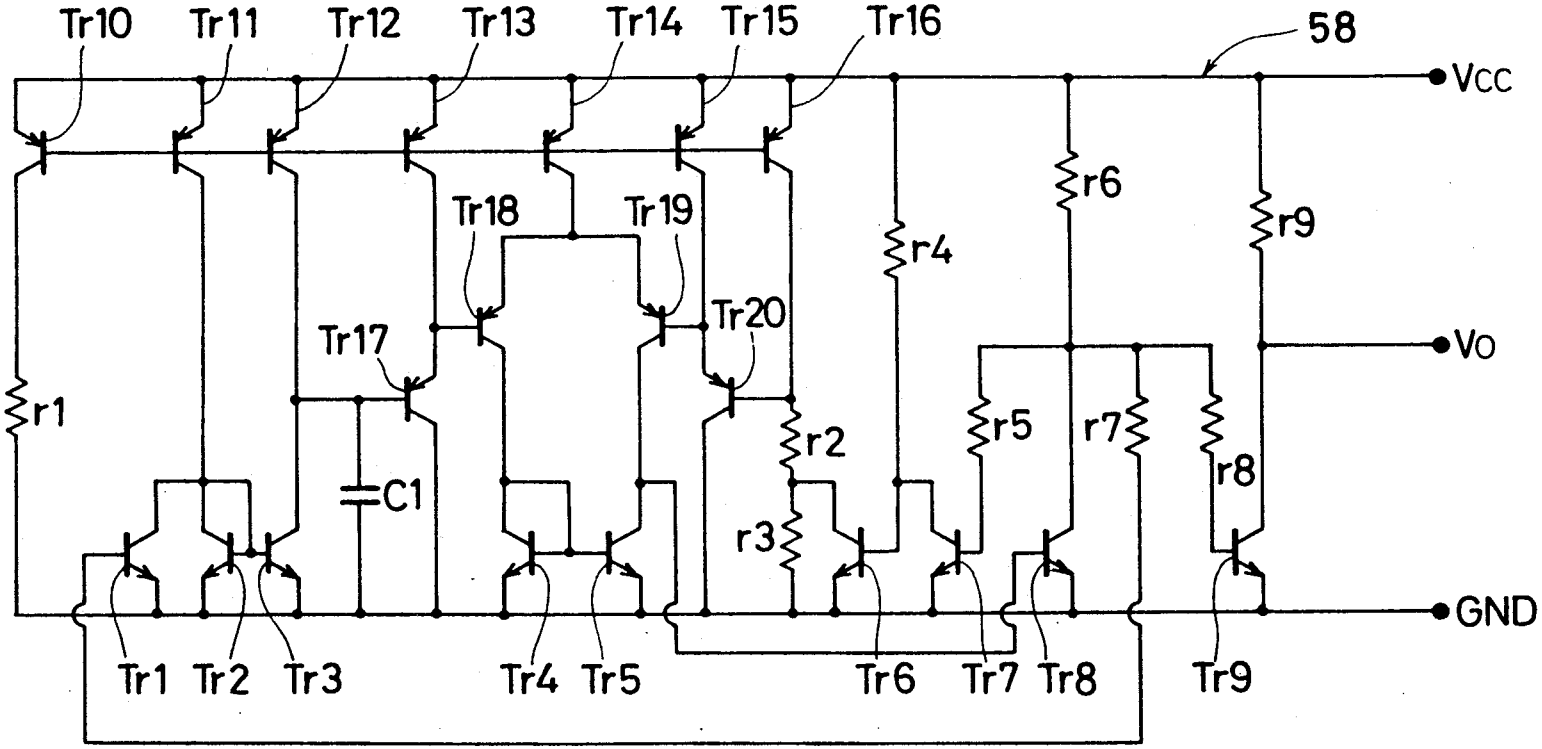
FIG. 3 is a circuit diagram showing one structural example of an oscillator.

Referring to FIGS. 1 through 3, the following description will discuss one embodiment of the present invention.

FIG. 1 shows a circuit configuration of a light-receiving section of a photocoupler of the present embodiment. In the light-receiving section, a photodiode 50, a light-proof photodiode 51, amplifiers 52 and 53, a comparator 54 and an output delay circuit 55 are monolithically integrated.

A cathode of the photodiode 50 is connected to an inverting input terminal of the amplifier 52 while an anode of the photodiode 50 is connected to a non-inverting input terminal thereof. A cathode of the light-proof photodiode 51 is connected to an inverting input terminal of the amplifier 53 while an anode of the light-proof photodiode 51 is connected to a non-inverting input terminal thereof. Additionally, the light-proof photodiode 51 is installed for generating a reference voltage to an output of the photodiode 50, and a light-proof material such as metal is employed in the light-proof photodiode 51. An output of the amplifier 52 is fed back to its own inverting input terminal through a feedback resistor 56, and also connected a non-inverting input terminal of the comparator 54. An output of the amplifier 53 is fed back to its own inverting input terminal through a feedback resistor 57, and also connected an inverting input terminal of the comparator 54. An output of the comparator 54 is connected to a data input terminal (hereinafter referred to as D-terminal) of a D-type flipflop (D-FF) circuit 60 in the output delay circuit 55.

The output delay circuit 55 generally includes the D-FF circuit 60, an oscillator 58, an updown counter 59, a decoder circuit 61, a clock signal supply control circuit 90 and an AND gate 67. Further, the clock signal supply control circuit 90 includes D-FF circuits 65 and 66, a discrimination circuit 62, an exclusive logic circuit 63 and an RS-type flipflop (RS-FF) circuit 64.

A clock signal input terminal CK (hereinafter referred to as CK-terminal) of the D-FF circuit 60 is connected to an output of the oscillator 58, while an output terminal Q (hereinafter referred to as Q-terminal) thereof is connected to a U/D-terminal of the updown counter 59 and also to one of the input terminals of an exclusive-OR circuit 79 in the exclusive logic circuit 63. Here, the updown counter 59 is switched in its operation between a counting-up mode and a counting-down mode depending on an output of the D-FF circuit 60 supplied to the U/D-terminal. Upon receiving a fall of a clock pulse signal released by the oscillator 58, the level of the Q-terminal of the D-FF circuit 60 as well as each level of the U/D-terminal of the updown counter 59 and one of the input terminals of the exclusive-OR circuit 79 changes from Low to High or from High to Low depending on the output of the comparator 54. Accordingly, the D-FF circuit 60 permits the output of the comparator 54 to be synchronized by the clock pulse signal supplied to the updown counter 59.

The updown counter 59 includes, for example, a 3-bit binary counter whose Q-terminals are connected to respective input terminals of a NAND circuit 69 in the decoder circuit 61 and also to respective input terminals of an OR circuit 70 in the decoder circuit 61. Further, each of the reset terminals R (hereinafter referred to as R-terminals) of the updown counter 59 is connected to an output of an initial reset circuit 68 while each of the CK-terminals is connected to an output of the AND gate 67.

The decoder circuit 61 is adapted to keep the output of the output delay circuit 55 Low when a counted value of the updown counter 59 has not reached a preset number (for example $2^2+2^1+2^0=7$), and to switch the output of the output delay circuit 55 to High only when the counted value of the updown counter 59 has reached the preset number. For this reason, the decoder circuit 61 includes NAND circuits 71 and 72 placed in bridge connection to each other, in addition to the NAND circuit 69 and the OR circuit 70. More specifically, an output of the NAND circuit 69 is connected to one of the input terminals of the NAND circuit 71, and an output of the OR circuit 70 is connected to one of the input terminals of the NAND circuit 72. An output of the NAND circuit 71 is connected to the other input terminal of the NAND circuit 72, and an output of the NAND circuit 72 is connected to the other input terminal of the NAND circuit 71. Moreover, the output of the NAND circuit 71 is on the one hand released as an output of the light-receiving section, and on the other hand connected to the other input terminal of the exclusive-OR circuit 79.

The discrimination circuit 62 includes an exclusive-OR circuit 73, AND circuits 74 and 75, NOT circuits 76, 77, 83 and an OR circuit 78 such that it can discriminate level variations of the output of the decoder circuit 61. That is, when the output of the decoder circuit 61 is switched from Low to High or from High to Low, the discrimination circuit 62 releases a detection signal. For this reason, one of the input terminals of the exclusive-OR circuit 73 is connected to a Q-terminal of the D-FF circuit 66 while the other input terminal of the exclusive-OR circuit 73 is connected to a Q-terminal of the D-FF circuit 65. One of the input terminals of the AND circuit 74 is connected to the output of the NAND circuit 71, and the other input terminal of the AND circuit 74 is connected to the output of the exclusive-OR circuit 73 by way of the NOT circuit 83. One of the input terminals of the AND circuit 75 is connected to the output of the NAND circuit 71 by way of the NOT circuit 76, and the other input terminal of the AND circuit 75 is connected to the output of the exclusive-OR circuit 73 by way of the NOT circuit 77. Further, an output of the AND circuit 74 is connected to one of the input terminals of the OR circuit 78, while an output of the AND circuit 75 is connected to the other input terminal of the OR circuit 78.

Furthermore, a D-terminal of the D-FF circuit 66 is connected to the output of the NAND circuit 71, and a D-terminal of the D-FF circuit 65 is connected to a Q-terminal of the D-FF circuit 66. Each of the CK-terminals of the D-FF circuits 65 and 66 is connected to the output of the oscillator 58. Thus, the output level of the Q-terminal of the D-FF circuit 66 is switched to the same level as the input level of the D-terminal upon having a fall of the clock pulse signal from the oscillator 58, while the output of the Q-terminal of the D-FF circuit 65 has a further delay of one clock to show the same level as the input level of the D-terminal of the D-FF circuit 66. By the use of these D-FF circuits 65 and 66, the discrimination circuit 62 releases as the detection signal a pulse signal having a pulse width corresponding to one clock.

The RS-FF circuit 64 includes NAND circuits 81 and 82 placed in bridge connection to each other. Thus, when a signal derived from the output of the exclusive-OR circuit 79 inverted by the NOT circuit 80 falls from High to Low, the output of the RS-FF circuit 64 is set. On the other hand, when an output of the discrimination circuit 62, that is, a detection signal released from the OR circuit 78, falls from High to Low, the output of the RS-FF circuit 64 is reset.

The AND gate 67 is adapted to send the output of the oscillator 58 to the updown counter 59 when the output of the RS-FF circuit 64 is High.

Additionally, as shown in FIG. 3, the oscillator 58 may be a known RC oscillator constituted of NPN transistors Tr1 to Tr9, PNP transistors Tr10 to Tr20, a capacitor C1 and resistors r1 to r9. The frequency is set to, for example, 100 kHz having a cycle of 10 μs.

In the above arrangement, operation of the output delay circuit 55 will be described hereinbelow with reference to a timing chart of FIG. 2. In FIGS. 1 and 2, B1 through B10 respectively represent the output signals of the comparator 54, oscillator 58, NAND circuit 69, OR circuit 70, decoder circuit 61, exclusive logic circuit 63, discrimination circuit 62, RS-FF circuit 64, AND gate 67 and D-FF circuit 60.

Here, as shown in FIG. 2(a), six terms, t1 through t6, are given in accordance with the level changes of the output B1 of the comparator 54. Suppose the output state of each bit in the updown counter 59 is given by (c, b, a). Then, the outputs of the updown counter 59 in turning the power source on are: (0, 0, 0).

After the photodiode 50 having started receiving light, when the output of the amplifier 52 exceeds the output of the amplifier 53, the output B1 of the comparator 54 becomes High as shown in FIG. 2(a). A term from High of the output B1 until noise interference is denoted as t1. When the output B10 of the D-FF circuit 60 becomes High, the output B5 of the decoder circuit 61 is still kept Low according to the output of the updown counter 59 as is shown in FIG. 2(e); the output of the exclusive-OR circuit 79 becomes High; and the output B6 of the exclusive logic circuit 63 becomes Low as is shown in FIG. 2(f).

Since the RS-FF circuit 64 is set when the output B6 is Low and further the output B7 of the discrimination circuit 62 is High (as will be described later, the output B7 turns Low for one clock upon having a level change of the output B5), the output B8 of the RS-FF circuit 64 becomes High as is shown in FIG. 2(h). At this time, the AND gate 67 opens, and the clock pulse signal is supplied to the updown counter 59 as is shown in FIG. 2(i).

The U/D-terminal of the updown counter 59 is kept High according to High of the output B1; therefore, the outputs of the updown counter 59 are updated following the sequence: (0, 0, 0)→(0, 0, 1)→(0, 1, 0). That is, as shown in FIG. 2(b), the updown counter 59 counts up the clock pulse signal during the term t1.

At this point, if noise N1 interferes the output B1 as shown in FIG. 2(a), one of the inputs of the exclusive-OR circuit 79 is forced Low due to the noise interference. However, since the other input of the exclusive-OR circuit 79 is maintained Low with the output B5 remaining Low, the output of the exclusive-OR circuit 79 becomes Low. Consequently, as shown in FIG. 2(f), the output B6 of the exclusive logic circuit 63 becomes High responding to the noise N1, and the output B8 of the RS-FF circuit 64 is maintained High since the output B7 of the discrimination circuit 62 is maintained High. Therefore, since the AND gate 67 is kept open regardless of the noise N1, the supply of the clock pulse signal to the updown counter 59 is continued.

Meanwhile, if noise N1 interferes the output B1, the U/D-terminal turns Low in response to the noise. Therefore, as shown in FIG. 2(b), the updown counter 59 counts down the clock pulse signal during the term t2. When the noise N1 disappears, the U/D-terminal turns High again, and as shown FIG. 2(b), the updown counter 59 counts up the clock pulse signal during the term t3.

Then, upon receiving the outputs (1, 1, 1) of the updown counter 59, the output B3 of the NAND circuit 69 becomes Low as shown in FIG. 2(c), while the output B4 of the OR-circuit 70 becomes High as shown in FIG. 2(d). Thus, the output B5 of the decoder circuit 61 goes to High as shown in FIG. 2(e).

Consequently, the output delay circuit 55 provides the output B5 having a rise delayed by delay time 1 (see FIG. 2(e)) without being influenced by noise interference at the output B1 of the comparator 54. Here, the delay time 1 corresponds to the time it takes for the outputs of the updown counter 59 to vary from (0, 0, 0) to (1, 1, 1).

When the output B5 becomes High, the output B6 of the exclusive logic circuit 63 becomes High as shown in FIG. 2(f) and further the discrimination circuit 62, as shown in FIG. 2(g), releases a detection signal R1 which is set to Low for one cycle of the clock pulse signal. Here, the following description will discuss operation of the discrimination circuit 62 for generating the detection signal R1. Since the output B5 is Low before the outputs of the updown counter 59 reach (1, 1, 1), both of the outputs of the D-FF circuits 65 and 66 are Low. This results in Low at the output of the exclusive-OR circuit 73. Therefore, the output of the AND circuit 75 becomes high, and the output of the OR circuit 78 becomes High. That is, as shown in FIGS. 2(e)

and 2(g), if the output B5 is Low, the output B7 of the discrimination circuit 62 is always kept High.

On the other hand, when the output B5 is switched to High, the output of the D-FF circuit 66 turns High and therefore the output of the D-FF circuit 65 is kept Low for one clock since it has a delay by one clock over the output of the D-FF circuit 66. Accordingly, since the output of the exclusive-OR circuit 73 becomes High, both of the AND circuits 74 and 75 become Low, thereby making the output of the OR circuit 78 fall to Low. However, since the output of the D-FF circuit 65 is switched to High upon receiving the next clock pulse signal, the output of the exclusive-OR circuit 73 is switched to Low. As a result, since the output of the AND circuit 74 becomes High, the output of the OR circuit 78 is returned to High.

In this manner, since the discrimination circuit 62 is adapted to release the detection signal R1 that turns Low for one cycle of the clock pulse signal, the output B8 of the RS-FF circuit 64 is reset to Low as shown in FIG. 2(h). As a result, the AND gate 67 is closed, and as shown in FIG. 2(i), since the clock pulse signal is no longer supplied to the updown counter 59, the updown counter 59 maintains the state (1, 1, 1).

Next, when light directed from the light generating section to the light receiving section is stopped, the output of the amplifier 52 drops, thereby making the output B1 of the comparator 54 set Low as indicated by the term t4 of FIG. 2(a). Successively, the output of the exclusive-OR circuit 79 of the exclusive logic circuit 63 is switched to High, and therefore the output B6 of the NOT circuit 80 becomes Low as shown in FIG. 2(f), thereby permitting the RS-FF circuit 64 to be reset to High as shown in FIG. 2(h). As a result, the AND gate 67 is opened as shown in FIG. 2(i), thereby supplying the clock pulse signal to the updown counter 59.

At this time, the U/D-terminal of the updown counter 59 is kept Low according to Low of the output B1; therefore, the outputs of the updown counter 59 are updated following the sequence: (1, 1, 1)→(1, 1, 0)→ (1, 0, 1). That is, as shown in FIG. 2(b), the updown counter 59 counts down the clock pulse signal during the term t4.

At this point, if noise N2 interferes the output B1 as shown in FIG. 2(a), one of the inputs of the exclusive-OR circuit 79 is forced High due to the noise interference. However, since the other input of the exclusive-OR circuit 79 is maintained High with the output B5 remaining High, the output of the exclusive-OR circuit 79 becomes Low. Consequently, as shown in FIG. 2(f), the output B6 of the exclusive logic circuit 63 becomes High responding to the noise N2, and the output B8 of the RS-FF circuit 64 is maintained High since the output B7 of the discrimination circuit 62 is maintained High. Therefore, since the AND gate 67 is kept open regardless of the noise N2, the supply of the clock pulse signal to the updown counter 59 is continued.

Meanwhile, if noise N2 interferes the output B1, the U/D-terminal of the updown counter turns High in response to the noise N2. Therefore, as shown in FIG. 2(b), the updown counter 59 counts up the clock pulse signal during the term t5. When the noise N2 disappears, the U/D-terminal turns Low again, and as shown FIG. 2(b), the updown counter 59 counts down the clock pulse signal during the term t6.

When the outputs of the updown counter 59 reach (0, 0, 0), the output B3 of the NAND circuit 69 becomes High, as shown in FIG. 2(c), and the output B4 of the OR circuit 70 becomes Low as is shown in FIG. 2(d). Therefore, the output B5 of the decoder 61 turns Low as is shown in FIG. 2(e).

Consequently, the output delay circuit 55 permits a fall of the output B5 to be delayed by delay time 2 (see FIG. 2(e)) over a fall of the output B1 of the comparator 54 without being influenced by noise interference at the output B1. Here, the delay time 2 corresponds to the time it takes for the outputs of the updown counter 59 to vary from (1, 1, 1) to (0, 0, 0).

When the output B5 becomes Low, the discrimination circuit 62, as shown in FIG. 2(g), releases a detection signal R2 which is set to Low for one cycle of the clock pulse signal, thereby permitting the output B8 of the RS-FF circuit 64 to be reset to Low as shown in FIG. 2(h). As a result, the AND gate 67 is closed, and as shown in FIG. 2(i), since the clock pulse signal is no longer supplied to the updown counter 59, the updown counter 59 maintains the state (0, 0, 0).

As described above, if noise interferes when the output of the comparator 54 is High, the updown counter 59 is adapted to count down. On the other hand, if noise interferes when the output of the comparator 54 is Low, the updown counter 59 is adapted to count up. With the arrangement, although the delay time 1 or 2 is prolonged depending on the time corresponding to a pulse width of noise present at the output of the comparator 54 in addition to the time required for the updown counter 59 to count up or count down the preset number, malfunction of the output delay circuit 55 due to noise is prevented and anti-noise characteristics can be improved.

SECOND EMBODIMENT

Figure 5:
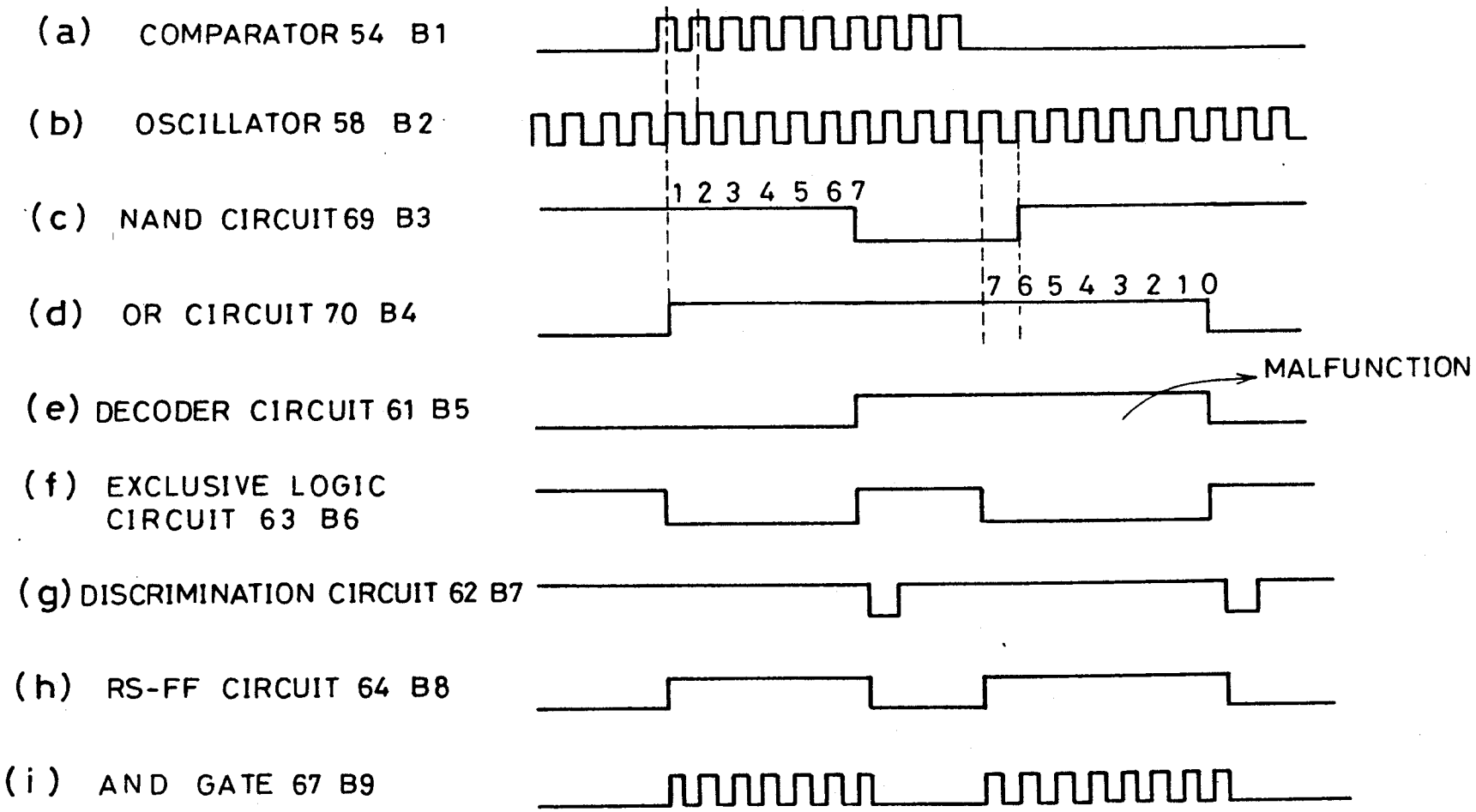
FIG. 5 is a timing chart showing each output in the light receiving section of FIG. 4.

In the output delay circuit 55 of the first embodiment, although it seldom takes place, malfunction might occur in the case where the high level of noise interfering the output B1 is synchronized with a rise of the clock pulse signal released from the oscillator 58, as shown in FIGS. 5(a) and 5(b). The reason is that the updown counter 59 is adapted to count the clock pulse signal in response to the level of the U/D-terminal upon having a rise of the clock pulse signal supplied thereto. If the high level of noise is synchronized with a rise of the clock pulse signal, the updown counter 59 is forced to count up the clock pulse signal regardless of the low level of the noise as shown in FIG. 5(c). In this case, after the updown counter 59 has reached a full-count state, since the output B3 of the NAND circuit 69 becomes Low and at this time the output of the OR circuit 70 is High as shown in FIGS. 5(c) and 5(d), this results in malfunction that the output B5 of the decoder circuit 61 might make a rise as shown in FIG. 5(e). Thereafter, since the output B1 becomes Low due to disappearance of noise, the output B5 of the decoder circuit 61 falls to Low in response to the counting-down operation of the updown counter 59. This process has already been described in the first embodiment.

Figure 4:
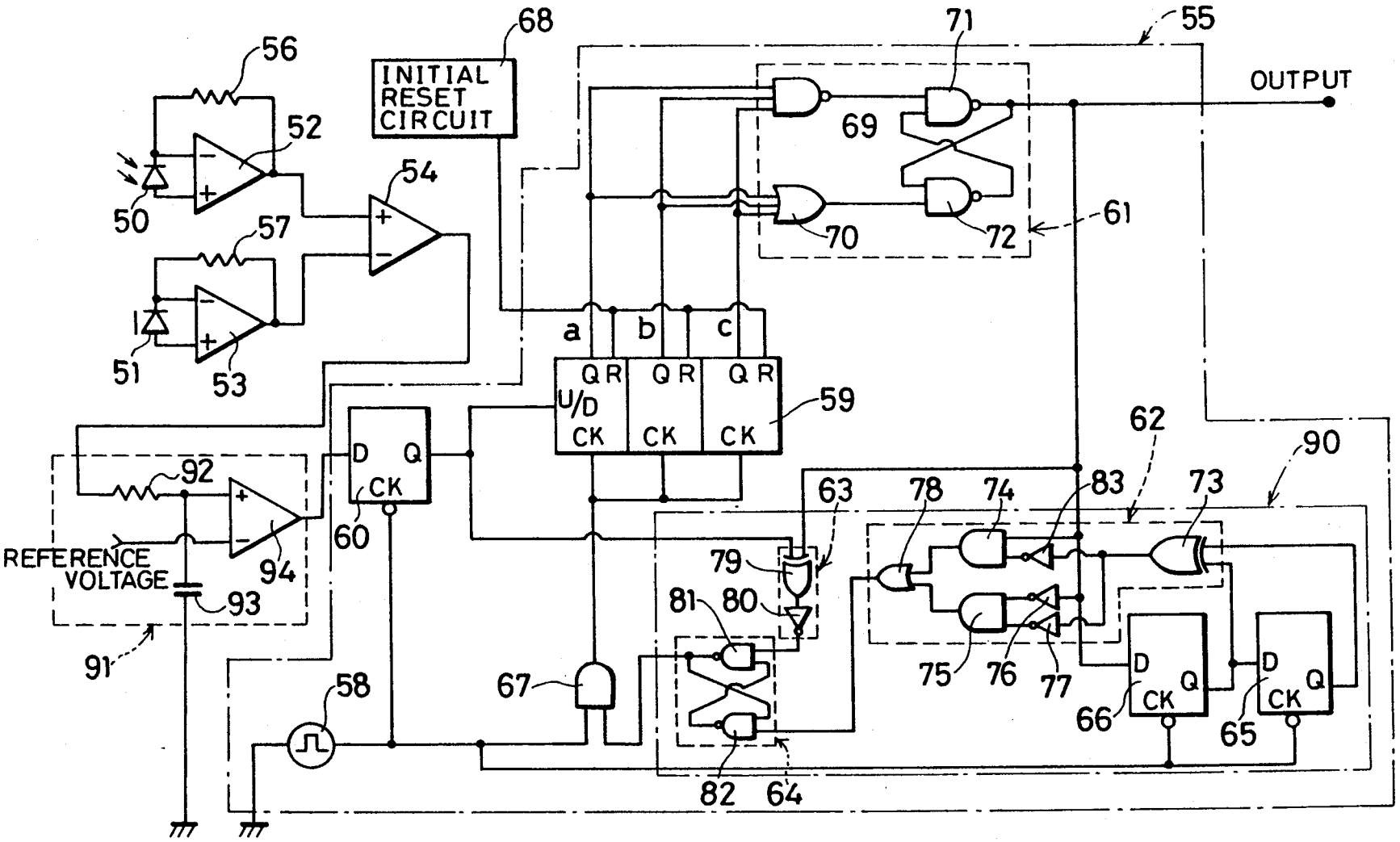
FIG. 4 is a circuit diagram showing another structural example of a light receiving section of a photocoupler according to the present invention.

In order to solve the above problem, the following description will discuss a configuration of a light receiving section having the output delay circuit 55 with further improved anti-noise characteristics, with reference to FIG. 4. Here, for convenience of explanation, those of the members having the same functions and described in the drawings of the first embodiment are indicated by the same reference numerals and the description thereof is omitted.

The light-receiving section of the present embodiment includes an integrating circuit 91 disposed between the comparator 54 and the D-FF circuit 60. The integrating circuit 91 includes a CR integrating circuit having a resistor 92 and a capacitor 93, and a comparator 94. More concretely, an output of the comparator 54 is connected to a non-inverting input terminal of the comparator 94 through the resistor 92. One end of the capacitor 93 is connected to a junction between the resistor 92 and the non-inverting input terminal of the comparator 94, while the other end of the capacitor 93 is connected to ground. A reference voltage is supplied to an inverting input terminal of the comparator 94. An output of the comparator 94 is connected to a D-terminal of the D-FF circuit 60.

Here, a time constant of the CR integrating circuit is set to be greater than an oscillating cycle of the oscillator 58.

In the above arrangement, the oscillating cycle of the oscillator 58 can be readily set to be several μs. For example, suppose that the value of the resistor 92 is 250 kΩ and that of the capacitor 93 is 20 pF in order to set the oscillating cycle to 5 μs, the time constant of the CR integrating circuit is equal to 5 μs. At this time, even if a cycle of noise is exactly the same as that of the oscillating cycle and their phases coincide with each other, the noise can be eliminated by the CR integrating circuit. Further, it is easy to integrate the resistor 92 and the capacitor 93 respectively having the above-mentioned values.

With this arrangement, most of the light receiving section can be monolithically integrated, and anti-noise characteristics of the output delay circuit 55 can be further improved.

Figure 6:
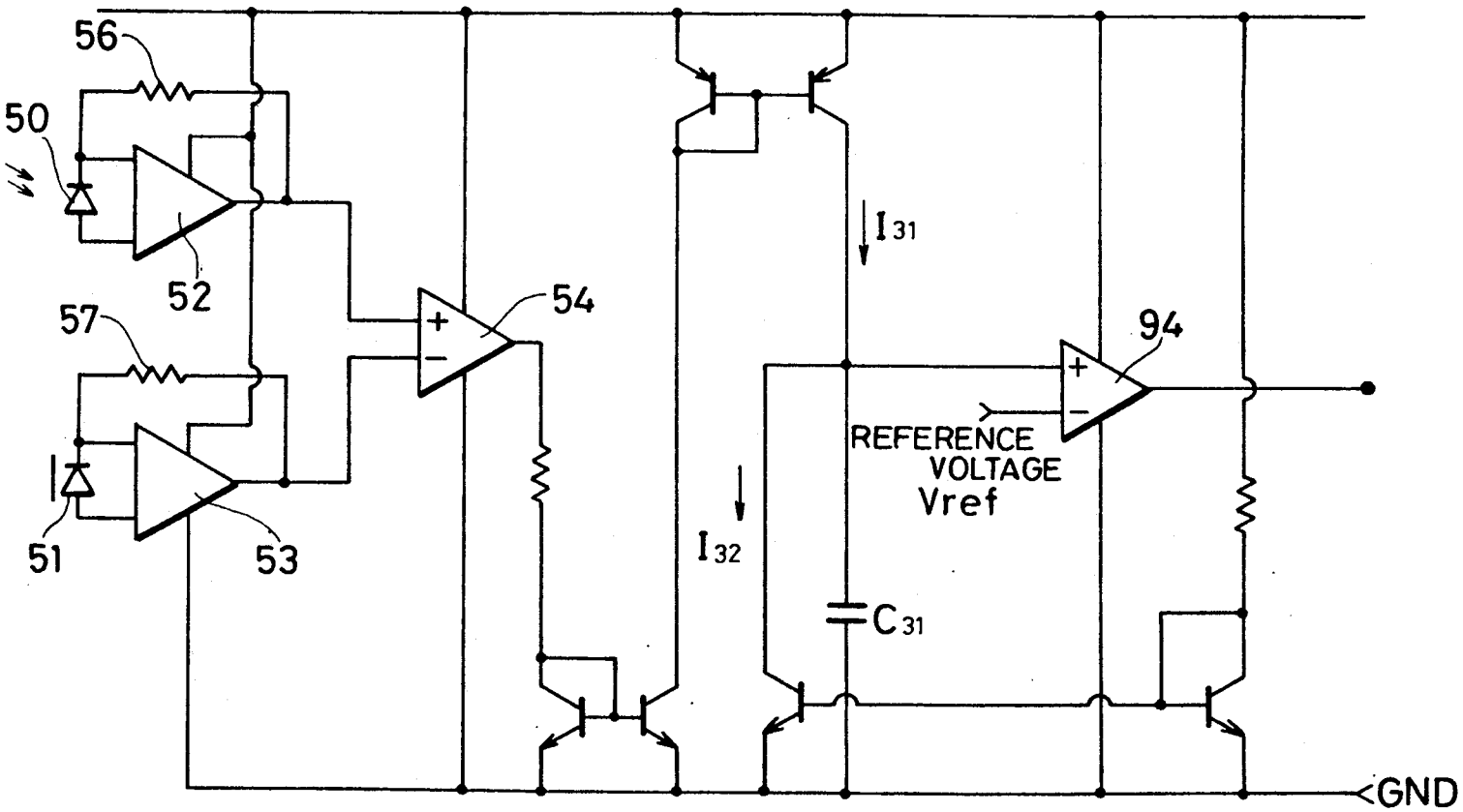
FIG. 6 is a circuit diagram showing another structural example of an integrating circuit in the light receiving section of FIG. 4.

The above-mentioned integrating circuit 91 may be replaced with a known Miller integrator shown in FIG. 6. Here, since a capacitor $C_{31}$ is charged by a constant current having an equal value to a current released from the comparator 54, precision of the output of the comparator 94 can be improved. In this case, suppose that a current flowing into a junction of the non-inverting terminal of the comparator 94 and the capacitor $C_{31}$ is denoted as $I_{31}$ and that a current flowing from the junction as an emitter current is denoted as $I_{32}$. Suppose that $I_{31}=2\times I_{32}$ holds between $I_{31}$ and $I_{32}$; a capacity of the capacitor $C_{31}$ is represented by $C_{31}$; and a reference voltage Vref is supplied to an inverting input terminal of the comparator 94, a time constant $\tau$ for charge/discharge of the capacitor $C_{31}$ is given by:

$$\tau=C_{31}\times Vref/I_{32}.$$

Additionally, for convenience of explanation, a 3-bit binary counter is used for the updown counter 59 in the first and second embodiments; yet, the output delay time may be desirably prolonged by increasing the number of bits N desirably. To sum up, if an oscillating cycle of the oscillator 58 is $T_1$ and at least output delay time of $T_2$ is needed, the number of bits can be set according to a relational expression:

$$T_2=2^N\times T_1.$$

For example, suppose that $T_1=10$ μs and $N=7$ are given in the expression, $T_2=2^7\times 10$ μs$=1.28$ ms holds. Thus, the output of the photocoupler can be delayed by at least 1.28 ms over the input thereof, by providing 7-bit binary counter for the updown counter 59.

THIRD EMBODIMENT

The output delay circuit 55 of the first embodiment has a comparatively complicated circuit configuration, since RS-FF circuit 64 is employed in the clock signal supply control circuit 90. Further, if radiation noise or other noise interferes the output of the RS-FF circuit constituted of the NAND circuits 71 and 72 in the decoder 61 thereby causing malfunction in the clock signal supply control circuit 90, the RS-FF circuit 64 will retain the malfunction because of its characteristics.

Figure 7:
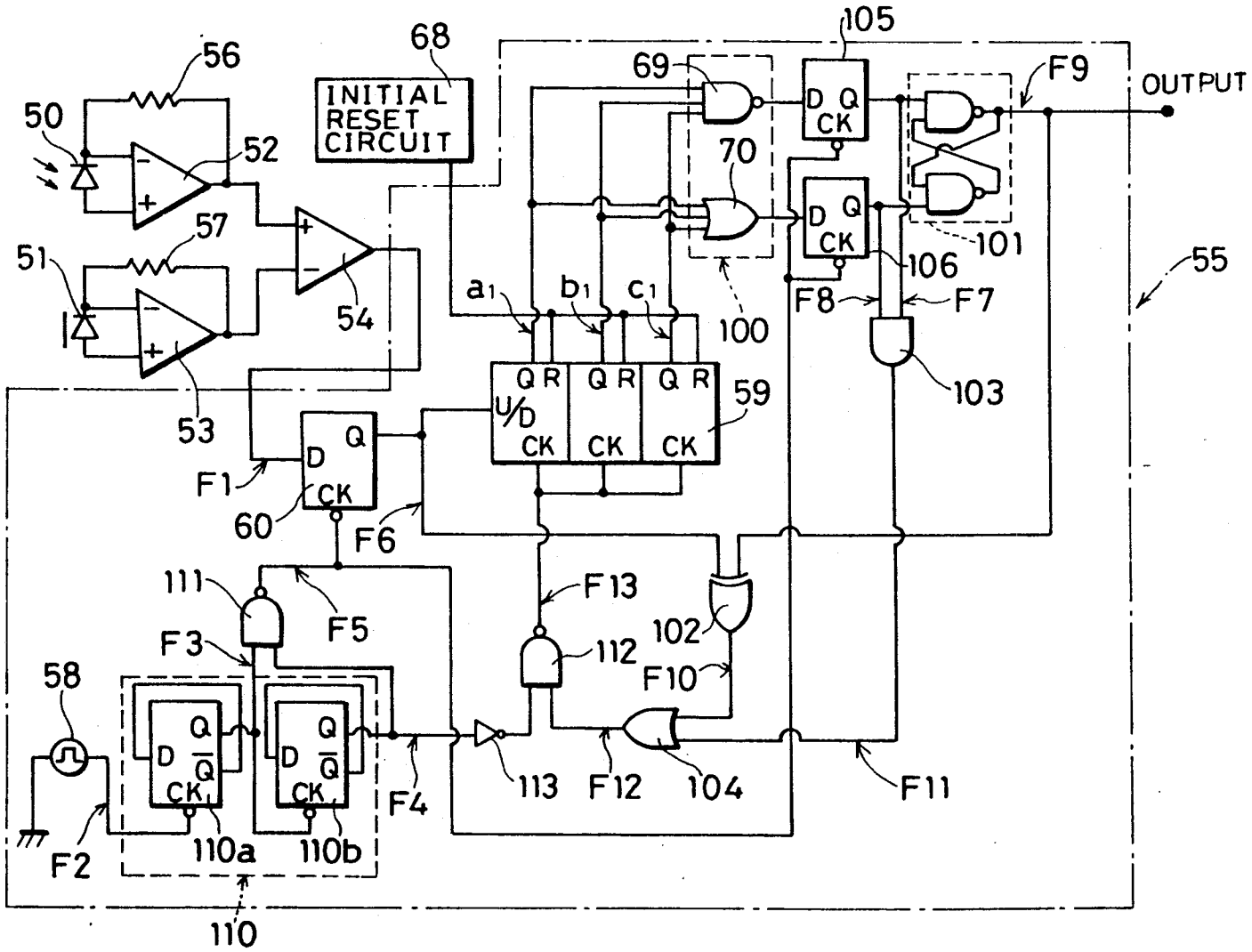
FIG. 7 is a circuit diagram showing still another structural example of a light receiving section of a photocoupler according to the present invention.
Figure 8:
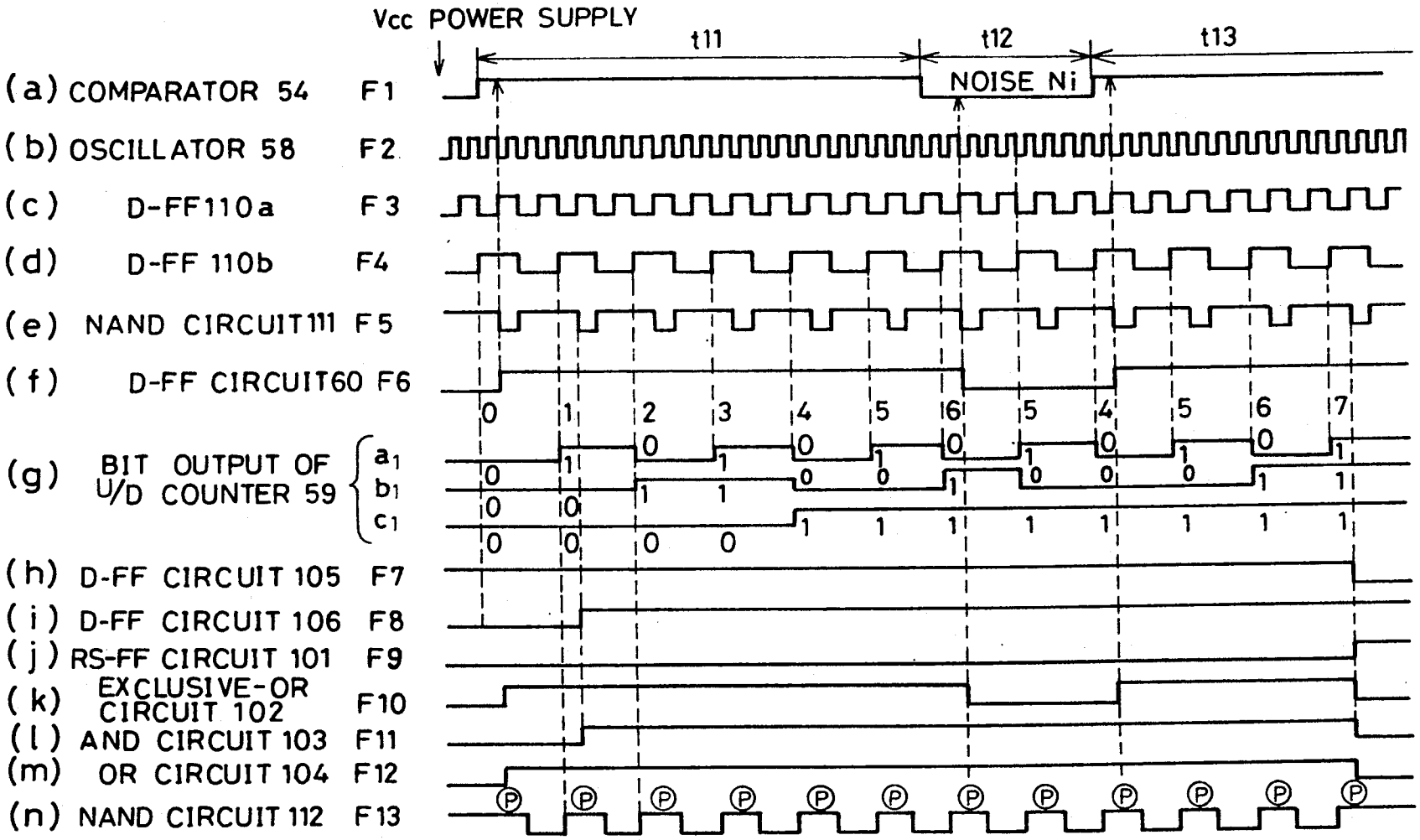
FIG. 8 is a timing chart showing each output in the light receiving section of FIG. 7.
Figure 9:
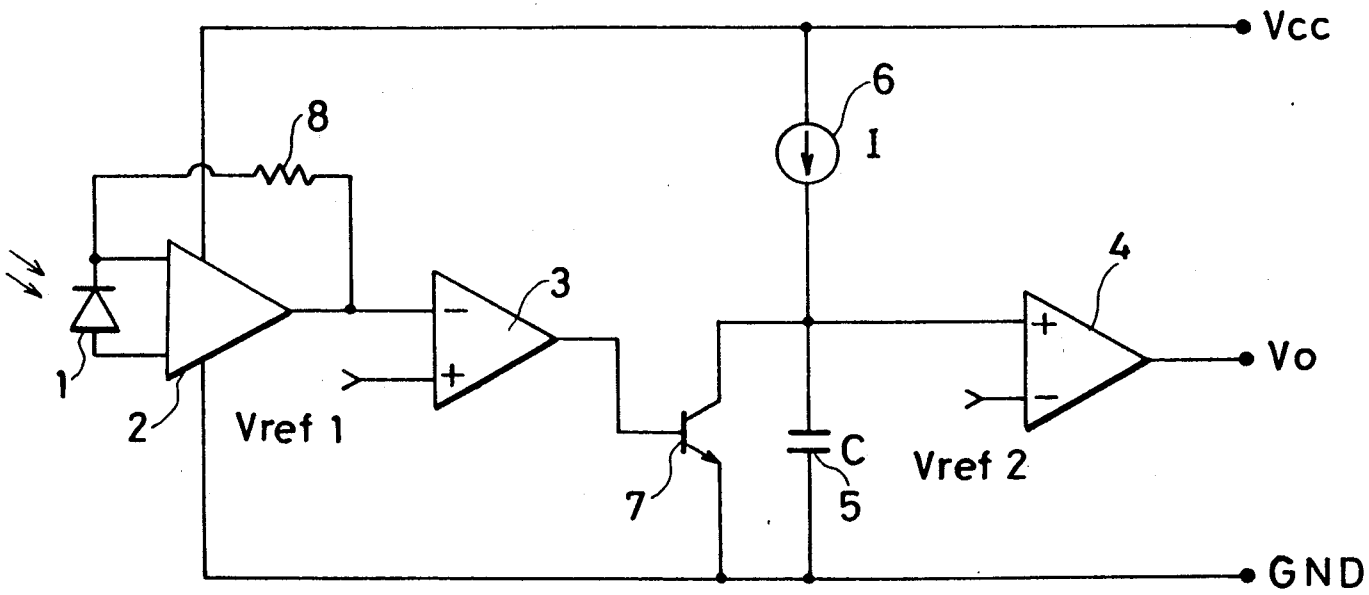
FIG. 9 is a circuit diagram showing one structural example of a light receiving section of a conventional photocoupler.
Figure 10:
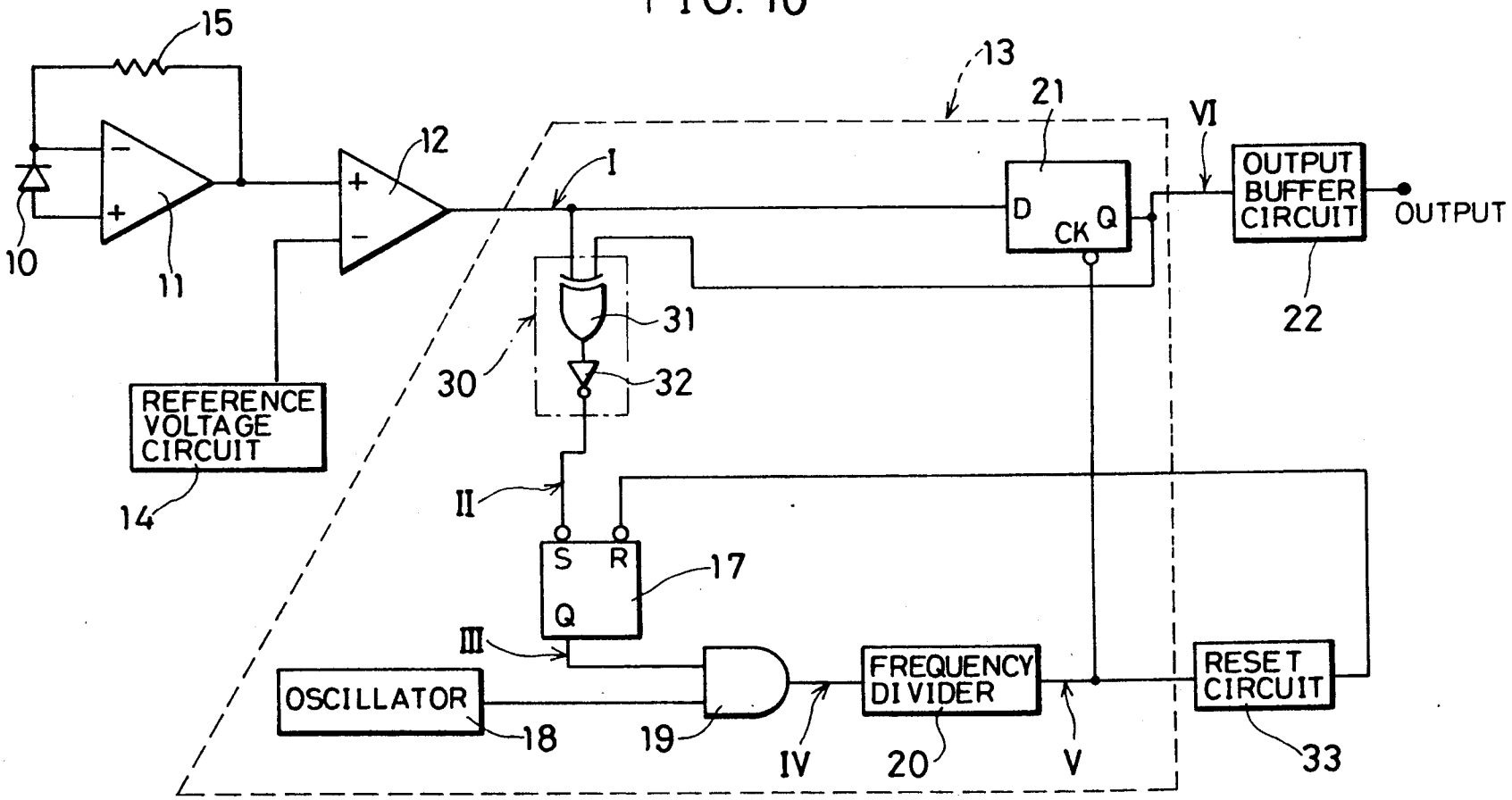
FIG. 10 is a circuit diagram showing one structural example of a modified light receiving section of the conventional photocoupler.
Figure 11:
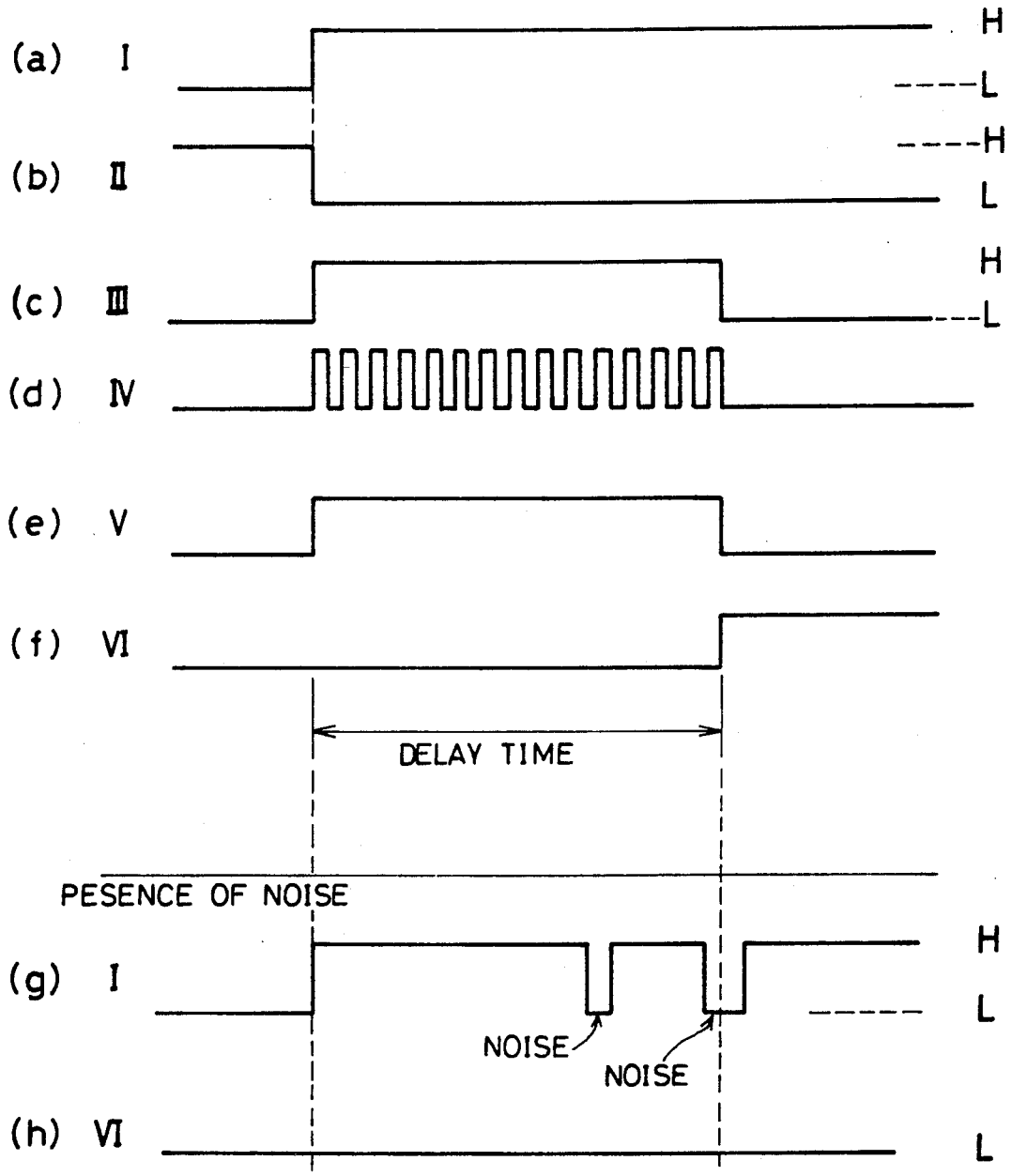
FIG. 11 is a timing chart of each output in the light receiving section of FIG. 10.
Figure 12:
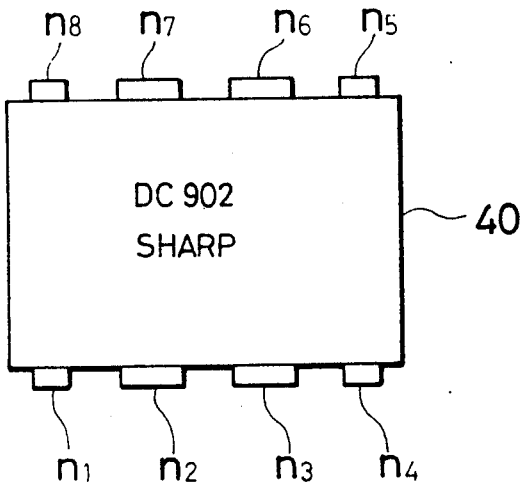
FIG. 12 is a plan view showing a conventional single-packaged photocoupler.
Figure 13:
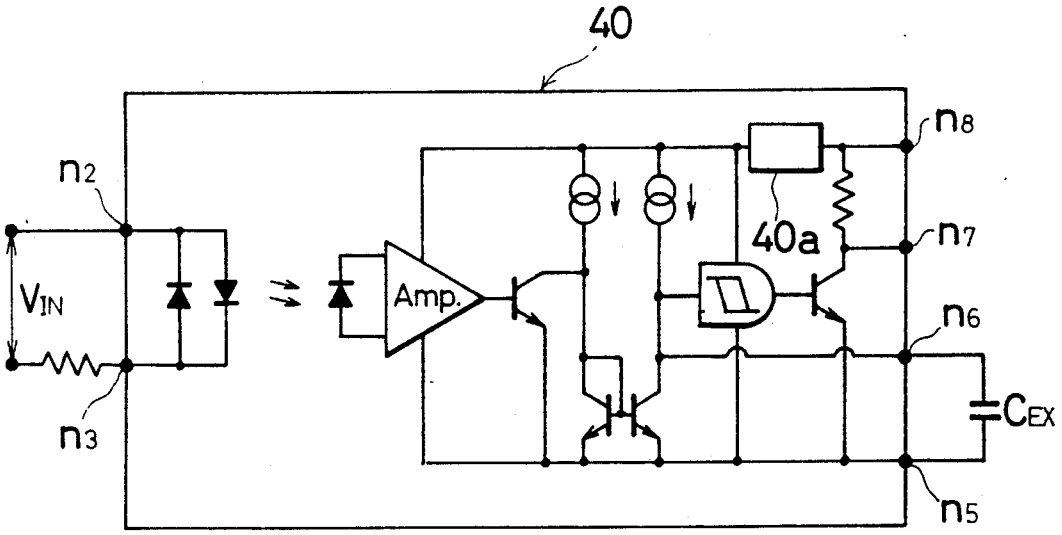
FIG. 13 is a circuit diagram showing a configuration of the photocoupler of FIG. 12.

Referring to FIGS. 7 and 8, the following description will discuss a third embodiment where, in integrating the output delay circuit 55, cost reduction thereof can be achieved by making the size of a chip more miniaturized and further, operation of the entire output delay circuit 55 can be more stabilized. Here, for convenience of explanation, those of the members having the same functions and described in the drawings of the first and second embodiments are indicated by the same reference numerals and the description thereof is omitted.

FIG. 7 shows a circuit configuration of the light-receiving section of a photocoupler according to the present embodiment. In the light-receiving section, the photodiode 50, light-proof photodiode 51, amplifiers 52 and 53, comparator 54 and the output delay circuit 55 are monolithically integrated, as with the case of the first and second embodiments.

In the output delay circuit 55, a D-terminal of the D-FF circuit 60 is connected to an output of the comparator 54. A Q-terminal of the D-FF circuit 60 is connected to a U/D-terminal of the updown counter 59 and one of input terminals of an exclusive-OR circuit 102. Thus, upon receiving a fall of a first divided clock signal F5 supplied to a CK-terminal of the D-FF circuit 60, the level of the Q-terminal of the D-FF circuit 60 as well as each of the levels of the U/D-terminal of the updown counter 59 and one of the input terminals of the exclusive-OR circuit 102 changes from Low to High or from High to Low depending on the output of the comparator 54. Accordingly, the D-FF circuit 60 permits the output of the comparator 54 to be synchronized by a second divided clock signal F13 supplied to the updown counter 59. Additionally, both the first divided clock signal F5 and the second divided clock signal F13, which will be described later, are derived from a clock pulse signal F2 generated by the oscillator 58.

Q-terminals of the updown counter 59 are connected to respective input terminals of a NAND circuit 69 in the decoder circuit 100 and also to respective input terminals of an OR circuit 70 in the decoder circuit 100. Further, each of the R-terminals of the updown counter 59 is connected to an output of an initial reset circuit 68. The initial reset circuit 68 provides "0" bit-by-bit to each output of the updown counter 59 when the power source is turned on.

The decoder circuit 100 detects the state where all the bits of the updown counter 59 are "0" or "1". An output of the NAND circuit 69 is connected to a D-terminal of the D-FF circuit 105 while an output of the OR circuit 70 is connected to a D-terminal of the D-FF circuit 106. The first divided clock signal F5 is supplied to respective CK-terminals of the D-FF circuit 105 and 106. Thus, D-FF circuits 105 and 106 permit respective outputs of the NAND circuit 69 and the OR circuit 70 to be synchronized with the second divided clock signal F13 supplied to the updown counter 59.

A Q-terminal of the D-FF circuit 105 is on the one hand connected to a set terminal of an RS-FF circuit 101 at the next stage, and on the other hand connected to one of the input terminals of the AND circuit 103. Further, a Q-terminal of the D-FF circuit 106 is on the one hand connected to a reset terminal of an RS-FF circuit 101, and on the other hand connected to the other input terminal of the AND circuit 103. An output F9 of the RS-FF circuit 101, which is released as an output of the output delay circuit 55, is connected to the other input terminal of the exclusive-OR circuit 102.

An output of the exclusive-OR circuit 102 is connected to one of the input terminals of an OR circuit 104, while an output of the AND circuit 103 is connected to the other input terminal of the OR circuit 104. An output of the OR circuit 104 is connected to one of the input terminals of a NAND gate 112. Thus, opening and closing of the NAND gate 112 are controlled by the output of the OR circuit 104. An output of the NAND gate 112 makes the second divided clock signal F13, and is connected to each of the CK-terminals of the updown counter 59.

Next, explanation will be made hereinbelow of a configuration for generating the first divided clock signal F5 and the second divided clock signal F13. The output of the oscillator 58 is connected to a CK-terminal of one of D-FF circuits 110*a* included in a frequency divider 110 at the next stage. A Q-terminal of the D-FF circuit 110*a* is on the one hand connected to a CK-terminal of the other D-FF circuit 110*b* included in the frequency divider 110, and on the other hand connected to one of the input terminals of a NAND circuit 111. A Q-terminal of the D-FF circuit 110*b* is on the one hand connected to the other input terminal of the NAND circuit 111, and on the other hand connected to the other input terminal of the NAND gate 112 through a NOT circuit 113. Here, Q-bar-terminals as respective inverting output terminals of the D-FF circuits 110*a* and 110*b*, are respectively connected to their own D-terminals.

An output of the NAND circuit 111, which makes the first divided clock signal F5, is connected to each of CK-terminals of respective D-FF circuits 60, 105 and 106.

Next, referring to a timing chart in FIG. 8, operation of the output delay circuit 55 will be described hereinbelow. Here, as shown in FIG. 8(a), three terms, t11 through t13, are given in accordance with the level changes of the output F1 released from the comparator 54. Suppose the output state of each bit in the updown counter 59 is given by ($c_1$, $b_1$, $a_1$). Then, the outputs of the updown counter 59 in turning on the power source Vcc are: (0, 0, 0).

Here, description will be made of the reason why the phases of the first divided clock signal F5 supplied to the D-FF circuits 60, 105 and 106 and the second divided clock signal F13 supplied to the updown counter 59 are arranged to be different from each other.

As shown in FIGS. 8(b) and 8(c), the D-FF circuit 110*a* divides down a frequency of the clock pulse signal F2 generated from the oscillator 58 into a ½ thereof, thereby generating a signal F3. Further, as shown in FIG. 8(d), the D-FF circuit 110*b* further divides down a frequency of the signal F3 into a ½ thereof, thereby generating a signal F4. Thus, as shown in FIG. 8(e), the first divided clock signal F5 is made of the signals F3 and F4 in the NAND circuit 111. The first divided clock signal F5, as is shown in FIGS. 8(d) and 8(e), is the same as the signal F4 in its cycle, but those signals have a ¼ cycle shift to each other in their timing of falling. Additionally, while the NAND gate 112 is opened, the signal F4 is supplied to the updown counter 59 as the second divided clock signal F13.

As a result of the above, a level change of the output F6 of the D-FF circuit 60 that is synchronous with a fall of the first divided clock signal F5, is synchronous not with a pulse edge of the second divided clock signal F13 but with a middle point p of a pulse top thereof, as is shown in FIGS. 8(e), 8(f) and 8(n). This arrangement allows switching between the counting-up operation and the counting-down operation of the updown counter 59 to be performed during a stabilized period of the updown counter 59. In the case where the switching between those operations in the updown counter 59 is performed in synchronism with a rise of the second divided clock signal F13, those operations of the updown counter 59 might become unstable since it is difficult to determine whether the on-coming operation will be of counting-up or of counting-down. Therefore, the above arrangement can eliminate this drawback.

After the photodiode 50 having started receiving light, when the output of the amplifier 52 exceeds the output of the amplifier 53, the output F1 of the comparator 54 becomes High as shown in FIG. 8(a). A term from receiving High of the output F1 until interference of noise Ni is denoted as t11. When the output F6 of the D-FF circuit 60 becomes High in synchronism with a fall of the first divided clock signal F5 as is shown in FIG. 8(f), an output F9 of the RS-FF circuit 101 is still kept Low according to the output of the updown counter 59 as is shown in FIG. 8(j). Accordingly, the output F10 of the exclusive-OR circuit 102 becomes High as shown in FIG. 8(k) and an output F12 of the OR circuit 104 becomes High as shown in FIG. 8(m). Consequently, since the NAND gate from the signal F4 is supplied to the updown counter 59 as shown in FIG. 8(n).

The updown counter 59 whose U/D-terminal is High according to High of the output F1, starts counting up the second divided clock signal F13. Then, as shown in FIGS. 8(g) and 8(n), an output state of each bit ($c_1$, $b_1$, $a_1$) is determined in synchronism with a rise of the second divided clock signal F13.

The output of the NAND circuit 69 becomes High if at least any one of those bits is a logical "0", and the output of the OR circuit 70 becomes High if at least any one of those bits is a logical "1". If all the bits show logical "1", that is, a full-count state, the output of the NAND circuit 69 becomes Low and the output of the OR circuit 70 becomes High. Therefore, the RS-FF circuit 101 keeps the output F9 Low until all the bits show logical "1", and switches the output F9 to High upon having logical "1"of all bits.

Next, as shown in FIG. 8(a), if noise Ni, which will be recognized as a Low Level, interferes the output F1 during a term t12, both of the outputs F6 and F9 become Low as shown in FIGS. 8(f) and 8(j), thereby forcing the output F10 of the exclusive-OR circuit 102 to become Low as shown in FIG. 8(k). Even in this case, since the outputs of the NAND circuit 69 and OR circuit 70 are maintained High as described above, the outputs F7 and F8 of the respective D-FF circuits 105 and 106 can be maintained High in spite of the interference of the noise Ni, as shown in FIGS. 8(h) and 8(i).

Accordingly, as shown in FIGS. 8(1) and 8(m), the respective outputs F11 and F12 of the AND circuit 103 and OR circuit 104 can be maintained High in spite of noise Ni, thereby permitting the NAND gate 112 to be kept open. Therefore, as shown in FIG. 8(n), the supply of the second divided clock signal F13 to the updown counter 59 is not stopped.

On the other hand, since the U/D-terminal of the updown counter 59 becomes Low due to the noise Ni, the updown counter 59 counts down the second divided clock signal F13 as shown in FIG. 8(g). However, since the output F9 of the RS-FF circuit 101 is kept Low as described above until all the bits of the updown counter 59 show logical "1", interference of the noise Ni into the output F9 can be prevented.

When the noise Ni disappears in a term t13 and the output F1 returns to High again as shown in FIG. 8(a), the output F6 is switched to High upon having a fall of the first divided clock signal F5 as well as having a middle point p of a pulse top of the second divided clock signal F13 as aforementioned. The updown counter 59 whose U/D-terminal has been switched to High, resumes to count up the second divided clock signal F13 which has been supplied thereto.

When an output state of each bit ($c_1$, $b_1$, $a_1$) of the updown counter 59 becomes (1, 1, 1), the output of the NAND circuit 69 becomes Low and the output of the OR circuit 70 becomes High as aforementioned. Therefore, as shown in FIG. 8(1), the output F11 of the AND circuit 103 becomes Low in synchronism with a fall of the first divided clock signal F5. On the other hand, as show in FIG. 8(j), the output F9 of the RS-FF circuit 101 becomes High in synchronism with a fall of the first divided clock signal F5. As a result, both of the inputs of the exclusive-OR circuit 102 become high, thereby permitting the output F10 of the exclusive-OR circuit 102 to become Low as shown in FIG. 8(k).

In this manner, since both of the outputs F10 and F11 turn Low in synchronism with a fall of the first divided clock signal F5, the output F12 of the OR circuit 104 becomes Low as shown in FIG. 8(m), thereby closing the NAND gate 112. Consequently, an output state of each bit ($c_1$, $b_1$, $a_1$) of the updown counter 59 is maintained (1, 1, 1). Here, it is noted that opening and closing of the NAND gate 112, that is, supply of the second divided clock signal F13 to the updown counter 59 can be controlled in synchronism with a fall of the first divided clock signal F5 by the mechanism that the same first divided clock signal F5 is supplied to the D-FF circuits 60, 105 and 106.

In the output delay circuit 55 of the present embodiment, it is possible to obtain by far a longer delay time than those output delay circuits 55 of the first and second embodiments, since the updown counter 59 is operated according to the second divided clock signal F13 obtained by dividing down a frequency of the clock pulse signal F2 into a ¼ thereof. Further, switching of the operation of the updown counter 59 is performed during a stable state of the updown counter 59. Moreover, since the output delay circuit 55 of the present embodiment does not employ an RS-FF circuit which is used in the clock signal supply control circuit 90 of the output delay circuits 55 of the first and second embodiments, the arrangement makes it possible to eliminate the drawback that radiation noise interfering the output of the RS-FF circuit 101 might affect opening and closing of the NAND gate 112. As a result, more stable operation of the output delay circuit 55 can be obtained.

Furthermore, by simplifying the clock signal supply control circuit, the size of a chip whereon the output delay circuit 55 is integrated can be miniaturized, and cost reduction of the chips can be achieved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A photocoupler which has a light generating section for converting an input signal into light and a light receiving section for converting the light from the light generating section into a signal and releasing the signal after having the signal subjected to a delay until at least the input signal becomes stable, comprising: light receiving means for receiving light from the light generating section; converting means for switching an output thereof from Low to High upon receipt of light by the light receiving means;

oscillating means for generating a clock signal;

an updown counter for counting the clock signal within 0 and a preset number, and switching an operation thereof between counting-up mode and counting-down mode according to an output of the converting means;

decoder means for switching an output thereof from Low to High when a counted value of the updown counter reaches a preset number after the updown counter started a counting-up operation in response to a first level change from Low to High of the output of the converting means; keeping the output thereof High until the preset number is counted down to "0" after the updown counter started a counting-down operation in response to a second level change from High to Low of the output of the converting means; switching the output thereof from High to Low when the counted value equals to zero; and forming an output of the photocoupler as its own output; and clock signal supply control means for supplying a clock signal to the updown counter since the first level change until a full-count state of the updown counter; and supplying the clock signal again to the updown counter since the second level change until the full-count value of the updown counter is counted down to "0", wherein the light receiving means, the converting means, the oscillating means, the updown counter, the decoder means and the clock signal supply control means are monolithically integrated.

2. A photocoupler as set forth in claim 1, further comprising:

dividing means for frequency-dividing the clock signal to generate a first sub-clock signal and a second sub-clock signal each having a different phase from the other, with the first sub-clock signal having at least either a falling pulse edge or a rising pulse edge synchronized with a pulse top of the second sub-clock signal; and first synchronizing means for permitting the output of the converting means to be synchronized with the first sub-clock signal, wherein the updown counter counts the second sub-clock signal within 0 and the preset number and switch an operation thereof between counting-up mode and counting-down mode according to an output of the first synchronizing means.

3. A photocoupler as set forth in claim 1, wherein:

the updown counter comprises a plurality of flipflop circuits, each releasing a binary signal corresponding to each bit of a count value of the updown counter; and the decoder means comprises a NAND circuit for entering an output of each flipflop circuit; a first OR circuit for entering an output of each flipflop circuit; second synchronizing means for permitting an output of the NAND circuit to be synchronized with the first sub-clock signal; third synchronizing means for permitting an output of the first OR circuit to be synchronized with the first sub-clock signal; and a first RS-type flipflop circuit being set by an output of the second synchronizing means and reset by an output of the third synchronizing means, whereby an output of the first RS-type flipflop circuit forms an output of the photocoupler.

4. A photocoupler as set forth in claim 1, further comprising:

an initial reset circuit for resetting the updown counter upon turning on the power source of the photocoupler.

5. A photocoupler as set forth in claim 3, wherein the first synchronizing means is a first D-type flipflop circuit whose data input terminal is connected to an output of the converting means.

6. A photocoupler as set forth in claim 5, wherein the clock signal supply control means comprises:

an exclusive-OR circuit for releasing an exclusive OR between an output of the first D-type flipflop circuit and an output of the first RS-type flipflop;

an AND circuit for releasing an AND between an output of the second synchronizing means and an output of the third synchronizing means;

a second OR circuit for releasing an OR between an output of the exclusive-OR circuit and an output of the AND circuit, whereby the second sub-clock signal is to be supplied to the updown counter with High of an output of the second OR circuit.

7. A photocoupler as set forth in claim 1, wherein:

the updown counter comprises a plurality of flipflop circuits, each releasing a binary signal corresponding to each bit of a count value of the updown counter; and the decoder means comprises a NAND circuit for entering an output of each flipflop circuit; an OR circuit for entering an output of each flipflop circuit; and a first RS-type flipflop circuit being adapted to be set by an output of the NAND circuit and reset by an output of the OR circuit, whereby an output of the first RS-type flipflop circuit forms an output of the photocoupler.

8. A photocoupler as set forth in claim 7 further comprising:

a first D-type flipflop circuit for receiving the clock signal, having a data input terminal, the data input terminal being connected to an output of the converting means such that the updown counter switches a counting operation thereof between counting-up mode and counting-down mode in response to an output of the first D-type flipflop circuit.

9. A photocoupler as set forth in claim 8, wherein the clock signal supply control means comprises:

an exclusive logic circuit for inverting an exclusive OR between an output of the first D-type flipflop circuit and an output of the first RS-type flipflop;

a detection signal generating circuit for generating a detection signal by detecting switching of an output of the first RS-type flipflop between High and Low; and a second RS-type flipflop circuit which is to be set upon receipt of an output of the exclusive-OR circuit and reset upon receipt of the detection signal;

whereby the clock signal is to be supplied to the updown counter with High of an output of the second RS-type flipflop circuit.

10. A photocoupler as set forth in claim 9, wherein the detection signal generating circuit comprises holding means for holding an output of the first RS-type flipflop circuit for one cycle of the clock signal when the output of the first RS-type flipflop circuit is switched between High and Low.

11. A photocoupler as set forth in claim 1 further comprising:

an integrating circuit for integrating an output of the converting means, the updown counter switching a counting operation thereof between counting-up mode and counting-down mode in response to an output of the integrating circuit.

12. A photocoupler as set forth in claim 11, wherein a time constant of the integrating circuit is set to be longer than a cycle of the clock signal.

13. A photocoupler as set forth in claim 1, wherein: the light receiving means is a first photodiode; and the converting means comprises:

a first amplifier whose non-inverting input terminal and inverting input terminal are connected to each other through the first photodiode;

a second amplifier whole non-inverting input terminal and inverting input terminal are connected to each other through a second photodiode shielded from light; and a comparator whose non-inverting input terminal is connected to an output of the first amplifier and whose inverting input terminal is connected to an output of the second amplifier.

14. A photocoupler as set forth in claim 9, wherein the detection signal generating circuit comprises:

a second D-type flipflop whose data input terminal is connected to an output of the first RS-type flipflop circuit and whose clock signal input terminal receives the clock signal;

a third D-type flipflop whose data input terminal is connected to an output of the second D-type flipflop circuit and whose clock signal input terminal receives the clock signal; and an exclusive-OR circuit for receiving each output of the second and third D-type flipflop circuits, whereby the detection signal generating circuit generates a pulse signal whose pulse width is equal to one cycle of the clock signal according to the output of the exclusive-OR circuit, when the output of the first RS-type flipflop circuit is switched between High and Low.

15. A photocoupler as set forth in claim 1 which is an electric device having the light-generating section and light-receiving section housed in a single package thereof.

16. A photocoupler as set forth in claim 1 which is used as one device for program controllers.

* * * * *